US010968701B2

(12) United States Patent
Phillips

(10) Patent No.: US 10,968,701 B2
(45) Date of Patent: Apr. 6, 2021

(54) APPARATUS FOR DRILLING AN OIL WELL USING A DOWNHOLE POWERED ROTATING DRILL SHOE MOUNTED ON CASING OR LINER

(71) Applicant: Steel Space Casing Drilling Ltd., Aberdeen (GB)

(72) Inventor: Alan Phillips, Aberdeen (GB)

(73) Assignee: Steel Space Casing Drilling Ltd., Aberdeen (GB)

( * ) Notice: Subject to any disclaimer, the term of this patent is extended or adjusted under 35 U.S.C. 154(b) by 0 days.

(21) Appl. No.: 16/251,271

(22) Filed: Jan. 18, 2019

(65) Prior Publication Data

US 2020/0232281 A1 Jul. 23, 2020

(51) Int. Cl.

| | |
|---|---|
| ***E21B 4/16*** | (2006.01) |
| ***E21B 4/02*** | (2006.01) |
| ***E21B 10/26*** | (2006.01) |
| *F04D 13/10* | (2006.01) |

(52) U.S. Cl.

CPC ..... *E21B 4/16* (2013.01); *E21B 4/02* (2013.01); *E21B 10/26* (2013.01); *F04D 13/10* (2013.01)

(58) Field of Classification Search

CPC ... E21B 4/16; E21B 4/02; E21B 10/26; F04D 13/10; F04D 13/12

See application file for complete search history.

(56) References Cited

U.S. PATENT DOCUMENTS

| | | | | |
|---|---|---|---|---|
| 4,501,454 | A * | 2/1985 | Dennis | E21B 4/003 384/619 |
| 5,911,284 | A * | 6/1999 | von Gynz-Rekowski | E21B 4/006 175/107 |
| 7,600,586 | B2 * | 10/2009 | Hall | E21B 4/006 175/106 |
| 7,712,549 | B2 | 5/2010 | Dennis et al. | |
| 8,770,317 | B2 * | 7/2014 | Kolle | E21B 4/006 175/107 |
| 2012/0201659 | A1 | 8/2012 | Savage et al. | |

FOREIGN PATENT DOCUMENTS

| | | |
|---|---|---|
| CN | 104389514 B | 8/2016 |
| JP | 2808191 B2 | 10/1998 |
| JP | 5155991 B2 | 3/2013 |

* cited by examiner

*Primary Examiner* — Michael R Wills, III

(74) *Attorney, Agent, or Firm* — Colby Nipper PLLC

(57) ABSTRACT

An apparatus for driving a drillable drill bit of a drilling assembly and a method of manufacturing of the apparatus for driving the drillable drill bit is provided. The apparatus employs a drilling assembly that includes one of a casing string or a tubular string suspendable in a borehole and a drill pipe housed within one of the casing string or the tubular string. The drillable drill bit is fixed at the bottom of the drill pipe. The drilling assembly further includes a plurality of motors mounted circumferentially on the one of casing string or tubular string, wherein the plurality of motors is attached to wall of the one of casing string or tubular string and are partially outside the one of casing string or tubular string in the borehole, and the plurality of motors are configured to drive the drillable drill bit.

14 Claims, 5 Drawing Sheets

APPARATUS FOR DRILLING AN OIL WELL USING A DOWNHOLE POWERED ROTATING DRILL SHOE MOUNTED ON CASING OR LINER

TECHNICAL FIELD

The present disclosure generally relates to downhole tools and more particularly to an apparatus configured to drive a drillable drill bit of a drilling assembly for drilling an oil well.

BACKGROUND

With advancements in the field of oil drilling, liner drilling technologies allow for strongly oriented wells which can achieve efficient results, given sufficient depth and with the proper tools. The liner drilling traditionally includes a large diameter pipe assembled and inserted into a recently drilled section of a borehole. The typical way of drilling includes creation of a well by drilling a hole of approximately 12 cm to 1 meter (5 in to 40 in) in diameter into the earth with a drilling rig that rotates a drill string with a bit attached. After the hole is drilled, sections of steel pipes (casing), slightly smaller in diameter than the borehole (downhole), are placed in the hole. Cement may be placed between the outside of the casing and the borehole known as the annulus.

Most liner drilling is achieved by rotating the casing drill from the rig floor top drive to drive a fixed drill bit at the downhole end of the drill pipe. This method may have numerous limitations as the torque limits of the casing connections are often reached before the desired depth is reached. Occasionally casing/liner drilling is achieved via complex drilling assemblies that deliver power to the drill bit downhole. However, these assemblies are recovered to surface once the well is drilled to the desired depth. This is time consuming and current products are both expensive and unreliable.

Therefore, to overcome above mentioned limitations, there is a need for a drilling assembly that is self-sustained and can achieve greater efficiency in a shorter time span.

SUMMARY

Embodiments of the invention provide an apparatus for driving a drillable drill bit, the apparatus comprising one of a casing string or a tubular string suspendable in a borehole and a drill pipe housed within the one of casing string or tubular string, where the drillable drill bit is fixed to bottom of the drill pipe. The apparatus further comprises a plurality of motors mounted circumferentially on the one of casing string or tubular string, wherein the plurality of motors is attached to wall of the one of casing string or tubular string and are partially outside the one of casing string or tubular string in the borehole and the plurality of motors are configured to drive the drillable drill bit.

According to one embodiment of the invention, each of the plurality of motors comprises a respective drive shaft.

According to one embodiment of the invention, the apparatus for driving the drillable drill bit further comprises a gear type assembly defined with a driver component and driven component, wherein the driver component is rotatably mounted on at least one drive shaft of the plurality of motors and the driven component is rotatably mounted on the drill pipe.

According to one embodiment of the invention, the plurality of motors are downhole motors.

According to one embodiment of the invention, the plurality of motors is powered by pressure and flow of a drilling fluid pumped through the drill pipe causing the driver component mounted on at least one drive shaft of the plurality of motors to drive the driven component mounted on the drill pipe.

According to one embodiment of the invention, the apparatus for driving the drillable drill bit further comprises at least one plug mounted internally on the one of casing string or tubular string, wherein the at least one plug is configured to divert the drilling fluid into the plurality of motors.

According to one embodiment of the invention, wherein the drill pipe is movably attached to the one of casing string or tubular string through bearings.

According to some embodiments, the invention provides a method of manufacturing an apparatus for driving a drillable drill bit. The method includes various steps of suspending one of a casing string or a tubular string in a borehole, positioning a drill pipe within the one of the casing string or the tubular string and fixing the drillable drill bit to the bottom of the drill pipe. The method further includes a step of mounting a plurality of motors circumferentially on one of the casing string or the tubular string, wherein the plurality of motors is attached to wall of the one of casing string or tubular string and is partially outside the one of casing string or tubular string in the borehole and the plurality of motors are configured to drive the drillable drill bit.

Embodiments of the invention provide a drilling assembly comprising one of a casing string or a tubular string suspended in a borehole, a drill pipe housed within the one of the casing string or the tubular string and a drillable drill bit fixed to bottom of the drill pipe, wherein the drillable drill bit is configured to drill the borehole. The drilling assembly further comprises a plurality of motors mounted circumferentially on the one of the casing string or tubular string, wherein the plurality of motors is attached to wall of the one of casing string or tubular string and are partially outside the one of the casing string or the tubular string in the borehole and the plurality of motors are configured to drive the drillable drill bit.

BRIEF DESCRIPTION OF THE DRAWINGS

Figure 1:
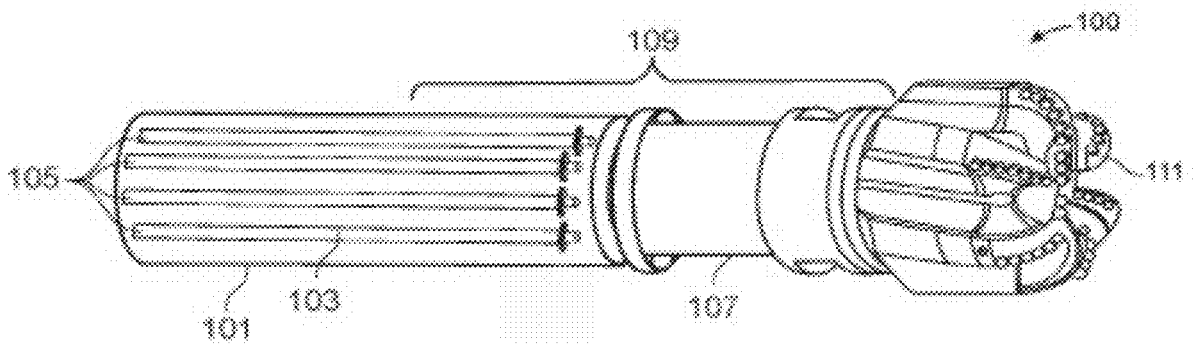
Figure 2:
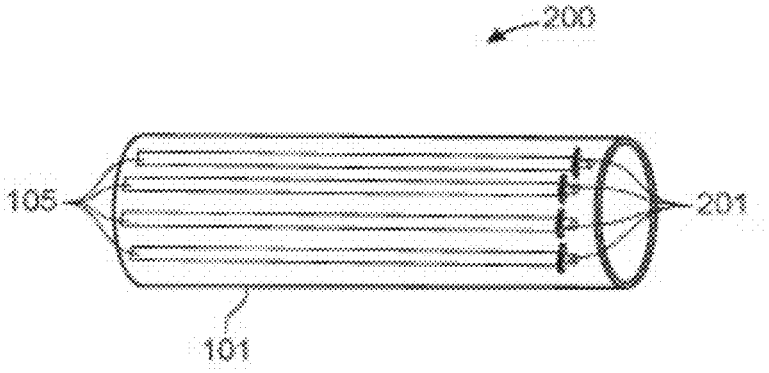
Figure 3:
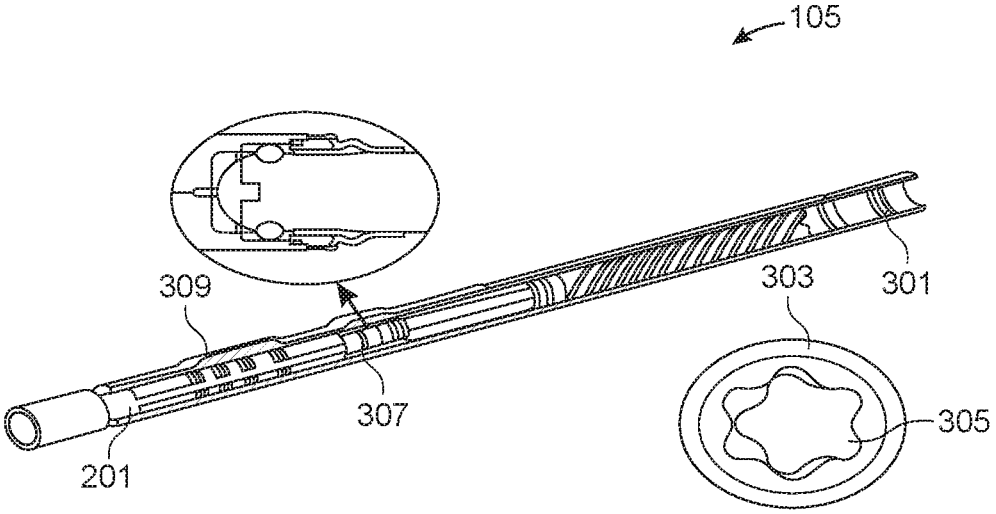
Figure 4:
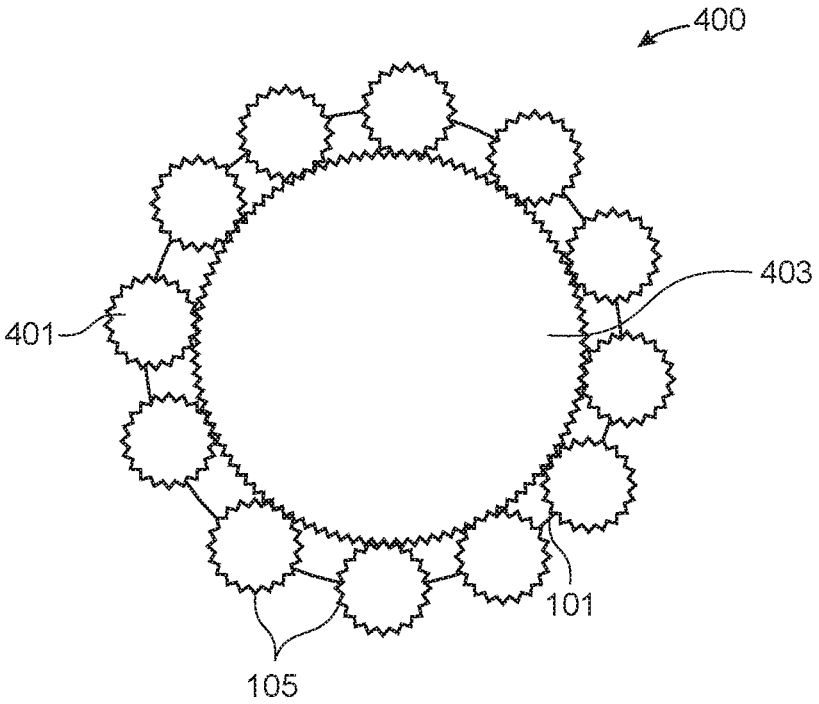
Figure 5:
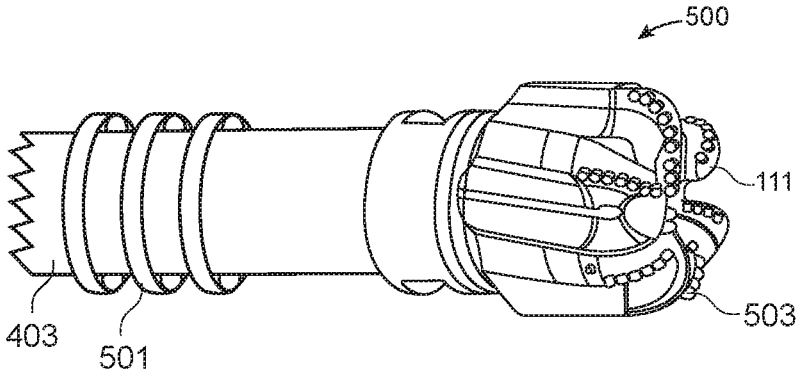
Figure 6:
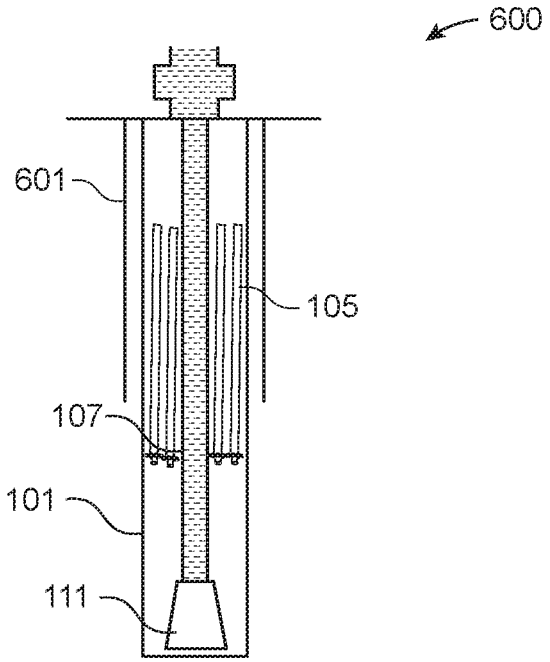
Figure 7:
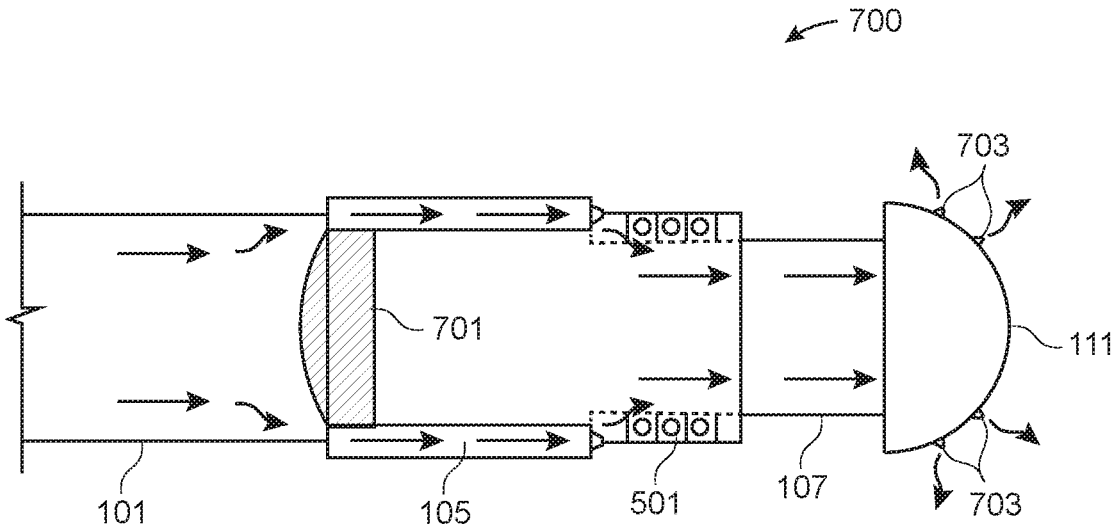
Figure 8:
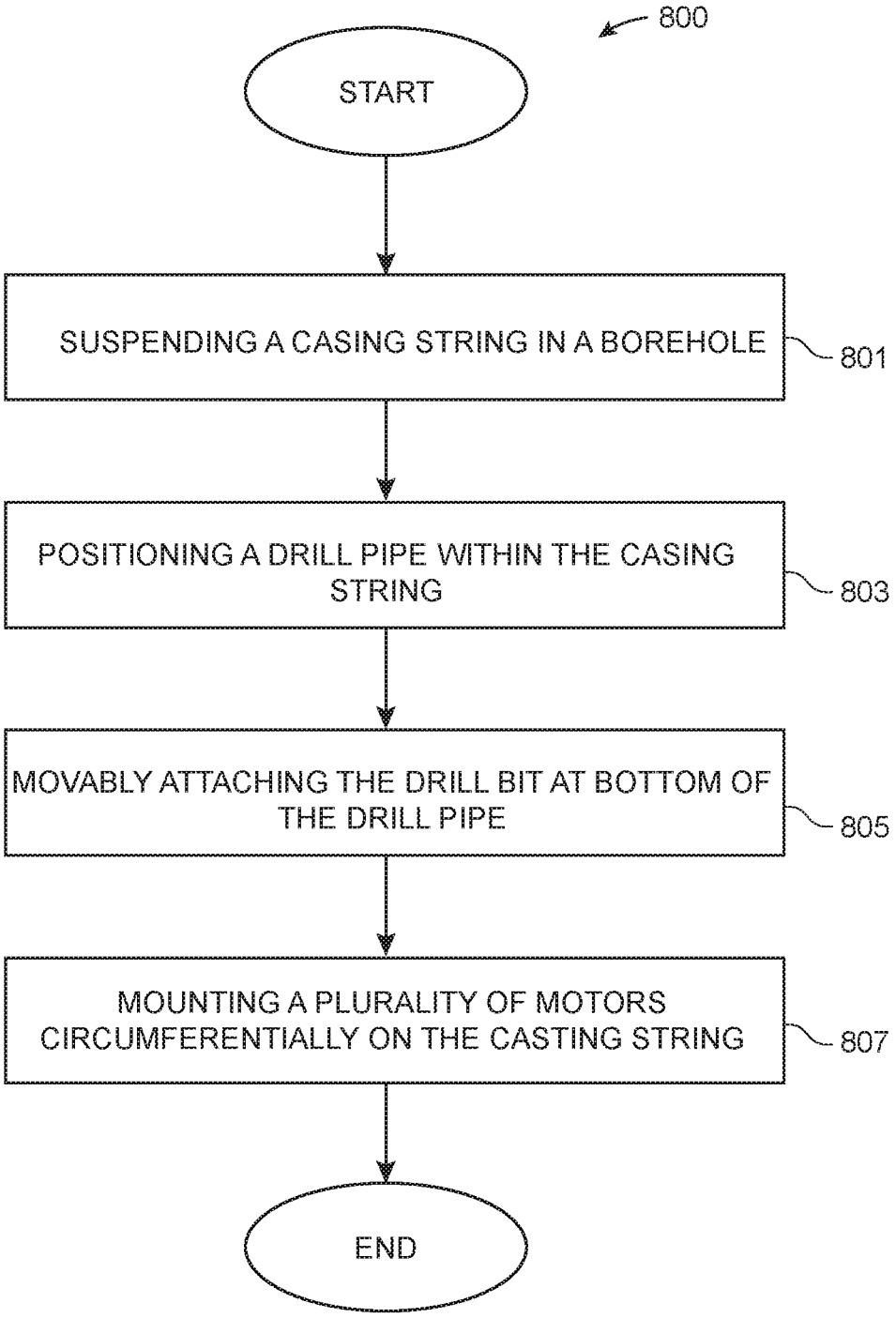

Having thus described example embodiments of the invention in general terms, reference will now be made to the accompanying drawings, which are not necessarily drawn to scale, and wherein:

FIG. 1 shows a perspective view of a drilling assembly, in accordance with an exemplary embodiment;

FIG. 2 shows a side elevated perspective view of a casing string of drilling assembly of FIG. 1, in accordance with an exemplary embodiment;

FIG. 3 shows an elevated perspective view of a motor associated with a drilling assembly of FIG. 1, in accordance with an exemplary embodiment;

FIG. 4 shows a sectional view of a gear assembly defined to couple a plurality of motors to a drill bit, in accordance with an exemplary embodiment;

FIG. 5 shows a side elevated perspective view of a drill bit, in accordance with an exemplary embodiment;

FIG. 6 shows a schematic representation of a drilling assembly, in accordance with an exemplary embodiment;

FIG. 7 shows a schematic representation of indication direction of drilling fluid through the drilling assembly of FIG. 1, in accordance with an exemplary embodiment; and FIG. 8 shows a flowchart of a method for manufacturing of an apparatus for driving a drill bit, in accordance with an example embodiment.

DETAILED DESCRIPTION

Some embodiments of the present invention will now be described more fully hereinafter with reference to the accompanying drawings, in which some, but not all, embodiments of the invention are shown. Indeed, various embodiments of the invention may be embodied in many different forms and should not be construed as limited to the embodiments set forth herein; rather, these embodiments are provided so that this disclosure will satisfy applicable legal requirements. Like reference numerals refer to like elements throughout. Also, reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification are not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Moreover, various features are described which may be exhibited by some embodiments and not by others. Similarly, various requirements are described which may be requirements for some embodiments but not for other embodiments.

The embodiments are described herein for illustrative purposes and are subject to many variations. It is understood that various omissions and substitutions of equivalents are contemplated as circumstances may suggest or render expedient but are intended to cover the application or implementation without departing from the spirit or the scope of the present disclosure. Further, it is to be understood that the phraseology and terminology employed herein are for the purpose of the description and should not be regarded as limiting. Any heading utilized within this description is for convenience only and has no legal or limiting effect.

An apparatus for driving a drill bit of a drilling assembly and a method of manufacturing of the apparatus for driving the drill bit is provided. The apparatus may employ a drilling assembly that includes one of a casing string or a tubular string suspendable in a borehole and a drill pipe housed within one of the casing string or the tubular string, where the drill bit is fixed at the bottom of the drill pipe. The drilling assembly further includes a plurality of motors mounted circumferentially on the one of casing string or tubular string, wherein the plurality of motors is attached to wall of the one of casing string or tubular string and are partially outside the one of casing string or tubular string in the borehole, and the plurality of motors are configured to drive the drill bit. As the diameter of each of the motors is much less than that of the diameter of the casing string, the motors allow a proceeding drilling movement of the drill bit without cutting or deforming the motors.

Further, a drilling fluid is allowed into the drilling assembly and further forced into the plurality of motors through a plug. The drilling fluid powers the plurality of motor and the motors generate torque that transfers to the drill bit through drive shafts of the plurality of motors. The drill bit rotates through the borehole and the drilling liquid oozes out from the tip of the drill bit to circulate back through an annulus created between casing and the borehole.

The apparatus for driving a drill bit of a drilling assembly and a method of manufacturing of the apparatus for driving the drill bit is described in FIG. 1 to FIG. 7.

FIG. 1 shows a perspective view of a drilling assembly 100, in accordance with an exemplary embodiment. The drilling assembly 100 employs a down-hole application of an apparatus 109 for driving a drill bit 111 of the drilling assembly 100 according to an embodiment of the present disclosure. In one example, the drilling assembly 100 may be used for liner drilling holes in oil-based industries, the drilling process comes after the exploration process to ensure the existence of crude oil. Several rig contractors and different service companies implement and manage the drilling process at well sites. The tool used to drill an oil well may be called as the drilling assembly 100 illustrated in FIG. 1. In another example, the drilling assembly may also be used to ream a pre-drilled borehole, which is unstable along with drilling of a new borehole.

The drilling assembly 100 majorly includes the drill bit 111 and the apparatus 109 for driving the drill bit 111. The apparatus 109 further includes a casing string 101, a plurality of motors 105 and a drill pipe 107. The plurality of motors 105 may be alternatively be referred as motors 105. The casing string 101 is suspended in a borehole (not shown in the FIG. 1). In one example, according to an aspect of the invention, borehole may be a deep, narrow hole made in the ground, especially to locate oil resources. Further, according to one embodiment, the casing string 101 is protected from the walls of the borehole and underground water layer by using multiple casing layers sealed off the casing string 101 all the way until the drilling bit 111. The motors 105 are mounted on the casing string 101. In one example, diameter of each of the plurality of motors 105 is significantly less than the diameter of the casing string 101. According to one aspect of the invention, the diameter of each of the plurality of motors is 25% or less than that of the diameter of the casing string 101. In one embodiment, the motors 105 are slim diameter positive displacement motors (PDM).

In one embodiment, the casing string 101 of the drilling assembly 100 may comprise plurality of slots 103, wherein each of the plurality of slots 103 is designed to accommodate each of the plurality of motors 105. In a preferred embodiment, the motors 105 are mounted on the external wall of the casing string 101 circumferentially, where a portion of each of the motors 105 is positioned outside the casing string 101, in other words, the motors 105 are positioned partially outside the casing string 101. In one example, the motors 105 are mounted on the casing string 101 via at least one process of welding, soldering, adhering or any known mechanical fittings such as elbows, tees, wyes, crosses, couplings, unions, compression fittings, caps, plugs and valves.

In an additional embodiment, the motors 105 are spaced evenly on the circumference of the casing string 101 and there may be any number of motors 105 used which are preferably laid out symmetrically across the circumference of the casing string 101. In a preferred embodiment, the number of motors 105 used may be between two to fifteen. In one example, the motors 105 are mounted in such a way that there is an access for diameter bigger or equal to the diameter of following drill bit 111. An exemplary embodiment showing the construction of the casing string 101 is described in FIG. 2.

FIG. 2 shows a side elevated perspective view 200 of a casing string 101 associated with a drilling assembly such as the drilling assembly 100 of FIG. 1, in accordance with an exemplary embodiment. In one example, the casing string 101 may be a long section of connected oilfield pipe that is lowered into the borehole and cemented. The purpose of the casing string 101 may be to prevent the collapse of the borehole, prevent formation fluids from entering the borehole in an uncontrolled way and prevent fluids in the borehole (such as produced oil or gas, drilling mud etc.) from entering other formations. In a preferred embodiment, a liner may be used in the place of casing string 101, where the liner may be defined as a type of casing string that does not extend back to the top of the borehole but is hung from another casing string (not shown in the FIG. 2).

In an alternative embodiment, the casing string 101 may be replaced with a tubular string. The tubular string is the conduit through which oil and gas are brought from the producing formations to the field surface facilities for processing. Tubing string must be adequately strong to resist loads and deformations associated with production and workovers. Further, tubing must be sized to support the expected rates of production of oil and gas. Clearly, tubing that is too small restricts production and subsequent economic performance of the well. Tubing that is too large, however, may have an economic impact beyond the cost of the tubing string itself, because the tubing size will influence the overall casing design of the well.

Further, the casing string 101 may be pipe that is assembled and inserted into a drilled section of the borehole. In one example, the working of the casing string 101 may be defined by quoting that the casing string 101 extends from the drilling assembly 100 from the setting depth up into another string of casing (not shown in the FIG. 2), usually overlapping about approximately 100 feet above the lower end of the intermediate or the oil string. The casing strings 101 are nearly always suspended a hanger device of the drilling assembly 100. Furthermore, according to one embodiment of the invention, the casing string 101 is defined with numerous evenly positioned slots 103. In one example, the slots 103 are elongated openings that are defined to accommodate the plurality of motors 105. In another example, the motors 105 are downhole motors, which according to present invention are positive displacement motors. In another embodiment, the majority portion of each of the motors 105 are positioned significantly outwards of the center line of the casing string 101 in such a way that, no portion of any motor 105 comes in the center line of the casing string 101. The construction of each of the motors 105, with respect to the present invention, includes a dump valve, a rotor, a stator and a drive shaft 201. The drive shaft is movably coupled to the drill pipe 107 (of FIG. 1) that is connected to a drill bit such as the drill bit 111 of FIG. 1.

In one embodiment, the motors 105 mounted on the casing string 101 are powered via are powered by pressure and flow of a drilling fluid pumped through the drill pipe 107 causing a driving component mounted on at least one drive shaft 201 of the plurality of motors 105 to drive the driven component mounted on the drill pipe 107. The drilling fluids, also referred to as drilling mud, are added to the drilling pipe 107 inside the casing string 101, to facilitate the drilling process by suspending cuttings, controlling pressure, stabilizing exposed rock, providing buoyancy, and cooling and lubricating. As drilling fluid is pumped through the motors 105, the motors convert the hydraulic power of the drilling fluid into mechanical power to cause the drilling bit 111 to rotate. In one example, during drilling process, cuttings are created. These cutting may pose a problem when the drilling is stopped which requires the drilling bit 111 replacement. The drilling fluids are used as a suspension tool to avoid the cuttings from filling the borehole as the drilling fluid circulates back to the top of the borehole through an annulus created between the casing string 101 and the borehole. The viscosity of the drilling fluid increases when movement of the drill bit 111 decreases, allowing the drilling fluid to have a liquid consistency during the drilling process and turn into a more solid substance when drilling is paused. Cuttings are then suspended in the well until the drill bit 111 is again inserted. This gel-like substance then transforms again into a liquid when drilling starts back on. In another example, the drilling fluids also help to control pressure in a well by offsetting the pressure of the hydrocarbons and the rock formations. Weighing agents are added to the drilling fluids to increase its density and, therefore, its pressure on the walls of the borehole. Also, another important function of drilling fluid is rock stabilization. Special additives are used to ensure that the drilling fluid is not absorbed by the rock formation in the well and that the pores of the rock formation are not clogged.

In one example, the drilling fluids may be water based, oil based or synthetic-based, and each composition provides different solutions in the borehole. If rock formation is composed of salt or clay, action must be taken for the drilling fluids to be effective. The drilling fluid engineer oversees the drilling, adding drilling fluid additives throughout the process to achieve more buoyancy or minimize friction based on the requirement. In addition to considering the chemical composition and properties of the well, a drilling fluid engineer must also take environmental impact into account when prescribing the type of drilling fluid necessary in a well. Oil-based drilling fluids may work better with a saltier rock. Water-based drilling fluids are generally considered to affect the environment less during offshore drilling.

Further, in one embodiment, the casing string 101 further includes a drilling packer, which alternatively referred to as a plug (not shown in the FIG. 2) that is mounted internally on the casing string 101. The plug is configured to direct the drilling fluid into the plurality of motors 105 and thus assist the motors 105 to power up. Further, the construction and working of the motors 105 are described in the FIG. 3.

FIG. 3 shows an elevated perspective view of a motor 105 associated with a drilling assembly such as the drilling assembly 100 of FIG. 1, in accordance with an exemplary embodiment. In one example, the motors 105 are positive displacement motors and the FIG. 3 employs the construction and working of a positive displacement motors which may be represented as the positive displacement motor 105. In an alternative embodiment, the motors 105 may be any other type of downhole motors such as turbine motors. The motor 105 includes a dump valve 301, stator-rotor assembly (303 and 305), coupling unit 307, stabilizer 309 and a drive shaft 201. According to one embodiment, the motors 105 are used for liner drilling through the borehole, where the dump valve 301 is defined to receive the drilling fluid. The drilling fluid is channeled to the center of the motor 105 through a plug (explained in FIG. 7), where the hydraulic energy provided by the drilling fluid is utilized to rotate a rotor 305 that eventually rotates the drive shaft 201. In one embodiment, the drive shaft 201 is coupled to the drill bit 111 and thus the motor 105 provide torque to the drill bit 111 as the drill bit 111 is fixed on the drill pipe 107.

The motor 105 includes the dump valve 301 to receive the drilling fluid, i.e., the dump valve 301 allows the drilling fluid circulation when the pressure is below a certain threshold. From dump valve 301, the drilling fluid flows to the stator 303 and rotor 305, which together may be called as an assembly. In one example, the rotor 305 may be a helicoidal rotor 305 within a molded, elastomer-lined stator 303. When the drilling fluid is forced through the assembly, the torque is imparted into the rotor 305 causing the rotor 305 to turn eccentrically. This generated torque transferred to the drill bit 111 through the stabilizer 309 and the drive shaft 201. Further, the motor 105 includes a coupling unit 307 that couples the drive shaft 201 with the assembly. In one embodiment, the drive shaft 201 is coupled to the drill bit 111 through any high functional material. Example of high functional material may be rubber or gritted material. In an alternative embodiment, the drill bit 111 is coupled to the motor 105 via gear assembly. The construction and working of the gear assembly is described in FIG. 4.

FIG. 4 shows a sectional view of a gear assembly 400 defined to couple a plurality of motors 105 to a drill bit 11, in accordance with an exemplary embodiment. In one example, the gear assembly 400 includes a driver component 401 and a driven component 403. The driver component 401 is defined on the drive shaft 201 (of FIG. 3) of each of the motors 105 and the driven component is defined on the drill pipe 107 (of FIG. 1) attached to the drill bit 111. In one example, the drill pipe 107 may be a pup joint. The pup joint may be defined as a pipe of non-standard length and is used to adjust the length of tubular structures to its exact requirement. In one embodiment, drill bit 11 may be welded on to the pup joint (or alternatively to the drill pipe 107). For an example, the pup joint may be of length varying between 2 ft and 8 ft long. In another embodiment, the pup joint may be screwed onto the casing string 101, allowing the torque to pass to the drill bit 111.

The driver component 401 of the gear assembly 400 may be a rotational machine configured with cut teeth that mesh with the driven component 403 of the gear assembly 400 to transmit torque. The driven component 403 attached on the drill pipe 107, transmits the torque to the drill pipe causing the rotation of the drill pipe 107 and in turn rotation of the drill bit 111. Alternatively, the driver component 401 and the driven component 403 may engage via a high friction coating. In one example, the motors 105 are spaced evenly on the casing string 101 and are positioned parallel to each other, allowing drive loads to be spread equally on the driver component 401 of each of the motors 105. In an alternative embodiment, similar result may be achieved if the motors 105 were spread in a random manner. According to an example, for every three rotation of the driver component 401 of each of the motors 105, the driven component 403 makes one rotation as the teeth ratio of the driven component 401 and the driven component 403 is 3:1, that is, for example, the driver component 401 may have 25 teeth whereas the driven component 403 would have 75 teeth.

After receiving the torque from the gear assembly 400, the working of the drill bit 111 along with the construction details are described in FIG. 5.

FIG. 5 shows a side elevated perspective view 500 of a drill bit 111, in accordance with an exemplary embodiment. In one example, the driven component 403 is a coupled to the drill pipe 107 through bearings 501. In one embodiment, the bearings 501 may be defined as a machine element that constrains relative motion to only the desired motion, and reduces friction between moving parts such as the drive component 403 and the drill pipe 107. The design of the bearings 501 may, for example, provide for free liner movement of the moving part or for free rotation around a fixed axis. Also, the bearing 501 may prevent a motion by controlling the vectors of normal forces that bear on the moving parts. Most bearings facilitate the desired motion by minimizing friction. Bearings 501 are classified broadly according to the type of operation, the motions allowed, or to the directions of the loads (forces) applied to the parts.

Further, the bearings 501 hold rotating components such as the drive shaft 201 within drilling assembly 100, and transfer axial and radial loads from a source of the load to the structure supporting it. That is, the bearing 501 transfer the torque from the motors 105 to the drill bit 111. In one example, the drill bit 111 may be a tool designed to produce a generally cylindrical hole (borehole) in the earth's crust by the rotary drilling method for the discovery and extraction of hydrocarbons such as crude oil and natural gas. This type of tool is alternately referred to as a rock bit, or simply a bit. Further, working of the drill bit 111 includes breaking of subsurface formations mechanically by cutting elements of the drill bit 111 by at least one method of scraping, grinding or localized compressive fracturing.

In one embodiment, the drill bit 111 when positioned in the borehole may pass through the plug and pass between the motors 105 without hindrance and drill the next portion of the borehole. The cuttings produced by the drill bit 111 are most typically removed from the borehole and continuously returned to the surface by the method of direct circulation.

According to one aspect of the invention, the drill bit 111 includes diamond cutters 503 which infers that the drill bit 111 may be polycrystalline diamond compact (PDC) bit. In one example, the PDC bits are designed and manufactured in two structurally dissimilar styles namely, Matrix-body bit and Steel-body bits. The two provide significantly different capabilities, and, because both types have certain advantages, a choice between them would be decided by the needs of the application.

Further, according to one aspect of the invention, the drill bit 111 is configured with multiple nozzles on the cutter 503. The nozzles assist the drilling fluid to ooze out and circulate back to the top of the borehole through the annulus. Further, an application of the drilling assembly is described in FIG. 6.

FIG. 6 shows a schematic representation 600 of a drilling assembly such as the drilling assembly 100 of FIG. 1, in accordance with an exemplary embodiment. According to the present embodiment, the drilling assembly is suspended in a borehole 601, wherein the drilling assembly is adapted to drill through the borehole 601. In one embodiment, the drilling assembly further includes a casing string 101 suspended in the borehole 601, a drill pipe 107 housed within the casing string 101. One end of the drill pipe 107 is protracted above the borehole 601 and further, receives drilling fluid from the end that is protracted above the borehole 601. The other end of the drill pipe 107 or the bottom of the drill pipe 107 is coupled to a drill bit 111, wherein the drill bit 111 is configured to drill through the borehole 601.

The drilling fluid forced into the drill pipe 107 is channeled to a plurality of motors 105. The plurality of motors 105 are mounted circumferentially on the casing string 101, wherein the plurality of motors 105 are positioned outside the casing string 101 in the borehole 601 and the plurality of motors 105 are configured to drive the drill bit 111.

FIG. 7 shows a schematic representation of indication direction of drilling fluid through the drilling assembly of FIG. 1, in accordance with an exemplary embodiment. In one embodiment, the flow of the drilling fluid may initiate when the drilling fluid is allowed into the casing string 101. From the casing string, the drilling fluid is channeled into plurality of motors 105 through a plug 701. In one embodiment, the plug 701 may be a cement plug which is a balanced plug of cement slurry placed in the borehole. Cement plugs are used for a variety of applications including hydraulic isolation, provision of a secure platform, and in window-milling operations for sidetracking a new wellbore. Further, the plug 701 channels the drilling fluid into the plurality of motors 105.

Further, according to one embodiment of FIG. 7, the drilling fluid flows out of the plurality of motor 105 through opening before bearing 501 into the drill pipe 107. Through drill pipe 107, the drilling fluid enters the drill bit 111 and comes out of the drilling assembly through multiple nozzles 703 positioned on the bottom of the drill bit 111. In one example, cement may be placed between the outside of the casing string 101 and the borehole known as the annulus and the drilling fluid returns up the annulus. In one embodiment, the casing string provides structural integrity to the newly drilled wellbore, in addition to isolating potentially dangerous high-pressure zones from each other and from the surface.

A method of manufacturing of an apparatus for driving the drill bit is described in FIG. 8.

FIG. 8 shows a flowchart of a method 800 for manufacturing of an apparatus for driving a drill bit, in accordance with an example embodiment. Each block of the flow diagram support combinations of means for performing the specified functions and combinations of operations for performing the specified functions. It will also be understood that one or more blocks of the flow diagram, and combinations of blocks in the flow diagram, may be implemented by special purpose hardware which perform the specified functions, or combinations of special purpose hardware and computer instructions. The method 800 starts at 801.

At 801, the method 800 includes a step of suspending a casing string in a borehole. At 803, the method 800 further include steps of positioning a drill pipe within the casing string and at 805, movably attaching the drill bit at bottom of the drill pipe. Further at 807, the method 800 includes a step of mounting a plurality of motors circumferentially on the casing string, wherein the plurality of motors is positioned outside the casing string in the borehole and the plurality of motors are configured to drive the drill bit.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What we claimed is:

1. An apparatus for driving a drillable drill bit, comprising:

a tubular string suspendable in a borehole;

a drill pipe housed within and extending axially from the tubular string, wherein a distal end of the drill pipe is configured to be fixable to the drillable drill bit;

a plurality of motors configured to drive the drillable drill bit, wherein the plurality of motors are mounted circumferentially on the tubular string, wherein the plurality of motors are attached to a wall of the tubular string and are located partially outside the tubular string and wherein each of the plurality of motors comprises a respective drive shaft; and a gear assembly comprising a driver component and a driven component, wherein the driver component is rotatably mounted on at least one of the drive shafts of the plurality of motors and the driven component is rotatably mounted on the drill pipe, the driven component disposed radially inwards of the driver component such that an outer surface of the driven component engages an inner surface of the driver component, and wherein the plurality of motors is configured to be powered by pressure and fluid of a drilling fluid pumped through the tubular string causing the driver component mounted on at least one drive shaft of the plurality of motors to drive the driven component mounted on the drill pipe.

2. The apparatus of claim 1, wherein the plurality of motors are downhole motors.

3. The apparatus of claim 1, further comprising at least one plug mounted internally on the tubular string, wherein the at least one plug is configured to divert the drilling fluid into the plurality of motors.

4. The apparatus of claim 1, wherein the drill pipe is movably attached to the tubular string via bearings.

5. The apparatus of claim 1, wherein the tubular string comprises or takes the form of a casing string, liner string or production tubing string.

6. A method of manufacturing an apparatus for driving a drillable drill bit, comprising:

providing a tubular string for being suspended in a borehole;

positioning a drill pipe within and extending axially from the tubular string;

fixing the drillable drill bit to a distal end of the drill pipe;

mounting a plurality of motors configured to drive the drillable drill bit circumferentially on the tubular string, wherein the plurality of motors are attached to a wall of the one of casing string or tubular string and are located partially outside the tubular string, and wherein each of the plurality of motors comprises a respective drive shaft; and providing a gear assembly comprising a driver component and a driven component, wherein the driver component is rotatably mounted on at least one of the drive shafts of the plurality of motors and the driven component is rotatably mounted on the drill pipe, the driven component disposed radially inwards of the driver component such that an outer surface of the driven component engages the inner surface of the driver component, and wherein the plurality of motors is powered by pressure and fluid of a drilling fluid pumped through the tubular string causing the driver component mounted on at least one drive shaft of the plurality of motors to drive the driven component mounted on the drill pipe.

7. The method of claim 6, wherein the plurality of motors are downhole motors.

8. The method of claim 6, further comprising mounting of at least one plug internally on the tubular string, wherein the at least one plug is configured to divert the drilling fluid into the plurality of motors.

9. The method of claim 6, wherein the drill pipe is movably attached to the tubular string via bearings.

10. The method of claim 6, wherein the tubular string comprises or takes the form of a casing string, liner string or production tubing string.

11. A drilling assembly, comprising:

the apparatus according to claim 1; and a drillable drill bit fixed to a distal end of the drill pipe of the apparatus, wherein the drillable drill bit is configured to drill through the borehole.

12. The drilling assembly of claim 11, wherein the drill pipe is movably attached to the tubular string via bearings.

13. The drilling assembly of claim 11, further comprising:

at least one plug mounted internally on the tubular string, wherein the at least one plug is configured to divert the drilling fluid into the plurality of motors.

14. The drilling assembly of claim 11, wherein the tubular string comprises or takes the form of a casing string, liner string or production tubing string.

* * * * *